US008443744B2

(12) United States Patent
Nakamura et al.

(10) Patent No.: US 8,443,744 B2
(45) Date of Patent: May 21, 2013

(54) SEWING MACHINE

(75) Inventors: Yoshinori Nakamura, Toyohashi (JP); Yoshio Nishimura, Nagoya (JP); Yutaka Nomura, Anjo (JP); Yuki Ihira, Kakamigahara (JP); Satoru Ichiyanagi, Nagoya (JP); Satoru Makino, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 13/240,206

(22) Filed: Sep. 22, 2011

(65) Prior Publication Data

US 2012/0073484 A1 Mar. 29, 2012

(30) Foreign Application Priority Data

Sep. 24, 2010 (JP) ..... 2010-213246

(51) Int. Cl.
*D05B 47/00* (2006.01)

(52) U.S. Cl.
USPC ..... 112/254

(58) Field of Classification Search
USPC ..... 112/154, 157, 305, 445, 453, 254, 112/475.01, 475.02, 475.03, 475.04, 470.02; 700/136, 138
See application file for complete search history.

(56) References Cited

U.S. PATENT DOCUMENTS

| | | | | |
|---|---|---|---|---|
| 4,590,878 | A * | 5/1986 | Conti | 112/400 |
| 5,323,722 | A * | 6/1994 | Goto et al. | 112/102.5 |
| 5,682,830 | A * | 11/1997 | Katou et al. | 112/225 |
| 7,299,757 | B2 | 11/2007 | Niizeki et al. | |
| 2009/0301369 | A1 | 12/2009 | Kawaguchi et al. | |

FOREIGN PATENT DOCUMENTS

| | | |
|---|---|---|
| JP | A-55-99473 | 7/1980 |
| JP | A-11-47472 | 2/1999 |
| JP | A-2005-224421 | 8/2005 |
| JP | A-2006-346087 | 12/2006 |
| JP | A-2008-212433 | 9/2008 |
| JP | A-2009-291416 | 12/2009 |

* cited by examiner

*Primary Examiner* — Tejash Patel
(74) *Attorney, Agent, or Firm* — Oliff & Berridge, PLC

(57) ABSTRACT

A sewing machine includes a control portion that controls a thread tension adjustment portion and a feed portion such that a first stitch and a second stitch are formed alternately on a sewing object. The first stitch includes only a stitch in which an interlacing point of the upper thread and a bobbin thread is lower than a top surface of the sewing object. The second stitch includes at least one set of a first section and a second section. The first section is a section in which the interlacing point and the bobbin thread are pulled out, by the thread tension, in the first direction on the top surface of the sewing object. The second section is a section in which the bobbin thread is pulled out in the second direction, and at least part of the second section overlapping with the first section.

5 Claims, 13 Drawing Sheets

FIG. 4

201

| DATA NUMBER | FEED AMOUNT | FLAG |
|---|---|---|
| 0 | 0 | 0 |
| 1 | -2 | 1 |
| 2 | 2 | 1 |
| 3 | 2 | 0 |
| 4 | 2 | 0 |

FIG. 8

202

| WIDTH (mm) | NUMBER OF SETS |
|---|---|
| 0 OR MORE, LESS THAN 0.3 | 1 |
| 0.3 OR MORE, LESS THAN 0.6 | 2 |
| 0.6 OR MORE, LESS THAN 0.9 | 3 |
| ⋮ | ⋮ |

FIG. 9

203

| FEED PITCH (mm) | NUMBER OF SETS |
|---|---|
| 1.0 OR MORE, LESS THAN 1.5 | 1 |
| 1.5 OR MORE, LESS THAN 3.0 | 2 |
| 3.0 OR MORE, LESS THAN 4.0 | 3 |
| ⋮ | ⋮ |

FIG. 10

204

| DATA NUMBER | FEED AMOUNT | FLAG |
|---|---|---|
| 0 | 0 | 0 |
| 1 | -2 | 1 |
| 2 | 2 | 1 |
| 3 | -2 | 1 |
| 4 | 2 | 1 |
| 5 | 2 | 0 |
| 6 | 2 | 0 |

FIG. 12

205

| THICKNESS (mm) | UPPER THREAD TENSION (FLAG = 0) (N) | UPPER THREAD TENSION (FLAG = 1) (N) |
|---|---|---|
| 0 OR MORE, LESS THAN 1.0 | 0.35 | 1.8 |
| 1.0 OR MORE, LESS THAN 2.0 | 0.35 | 2.8 |
| 2.0 OR MORE, LESS THAN 3.0 | 0.35 | 3.8 |
| ⋮ | ⋮ | ⋮ |

SEWING MACHINE

CROSS-REFERENCE TO RELATED APPLICATION

This application claims priority to Japanese Patent Application No. 2010-213246, filed Sep. 24, 2010, the content of which is hereby incorporated herein by reference in its entirety.

BACKGROUND

The present disclosure relates to a sewing machine that includes a thread tension adjustment portion that adjusts a tension of an upper thread that is supplied to a sewing needle and a feed portion that can feed a sewing object in a first direction and in a second direction that is a direction opposite to the first direction.

In related art, a sewing machine is known that has a function to form hand-sewn style stitches. The hand-sewn style stitches are stitches that are formed on one surface of the sewing object by alternately forming a stitch in which a colored thread can be seen and a stitch in which a colored thread cannot be seen. In a case where the hand-sewn style stitches are formed, a transparent thread is used as an upper thread and a colored thread is used as a bobbin thread.

SUMMARY

For the stitch in which the colored thread can be seen, a feed pitch (a feed amount per each needle drop) of the sewing object is made shorter and the tension of the upper thread is controlled such that a node point (an interlacing point) between the transparent upper thread and the colored bobbin thread appears on the top surface of the sewing object and the stitch is sewn. For the stitch in which the colored thread cannot be seen, the tension of the upper thread is controlled such that only the transparent upper thread can be seen and the stitch is sewn. By performing the sewing in this manner, the colored bobbin thread can be seen such that it is arranged with a specific length and at a specific interval. However, there are cases in which the hand-sewn style stitches sewn by known sewing machines may not look like hand-sewn style stitches, as the colored thread that is the bobbin thread is not arranged at the specific length and at the specific interval.

Various embodiments of the broad principles derived herein provide a sewing machine that can favorably form hand-sewn style stitches on a sewing object.

Embodiments provide a sewing machine that includes a thread tension adjustment portion that adjusts a thread tension, a feed portion that can feed a sewing object in a first direction and in a second direction, and a control portion that controls the thread tension adjustment portion and the feed portion such that a first stitch and a second stitch are formed alternately on the sewing object. The thread tension is a tension of an upper thread that is supplied to a sewing needle. The second direction is a direction opposite to the first direction. The first stitch includes only a stitch in which an interlacing point of the upper thread and a bobbin thread that is a different color to the upper thread is lower than a top surface of the sewing object. The second stitch includes at least one set of a first section and a second section. The first section is a section in which the interlacing point and the bobbin thread are pulled out, by the thread tension, in the first direction on the top surface of the sewing object. The second section is a section in which the bobbin thread is pulled out in the second direction, and at least part of the second section overlapping with the first section.

BRIEF DESCRIPTION OF THE DRAWINGS

Embodiments will be described below in detail with reference to the accompanying drawings in which:

FIG. 4 is an explanatory diagram of sewing data used to sew hand-sewn style stitches;

FIG. 8 is a table representing relationships between a width (mm) of an upper thread and a number of sets of a first section and a second section that are included in each of second stitches;

FIG. 9 is a table representing relationships between a feed amount per each needle drop (a feed pitch) (mm) and the number of sets of the first section and the second section that are included in each of the second stitches;

FIG. 10 is an explanatory diagram of sewing data to sew hand-sewn style stitches in a case where the number of sets of the first section and the second section included in each of the second stitches is two;

FIG. 12 is a table representing relationships between a thickness (mm) of a sewing object and an upper thread tension (N)

DETAILED DESCRIPTION

A sewing machine 1 according to an embodiment of the present disclosure will be described below with reference to the drawings.

A physical configuration of the sewing machine 1 will be described with reference to FIG. 1 and FIG. 2. In the following explanation, the left diagonal lower side, the right diagonal upper side, the left diagonal upper side and the right diagonal lower side shown in FIG. 1 are, respectively, the left side, the right side, the rear and the front of the sewing machine 1.

Figure 1:
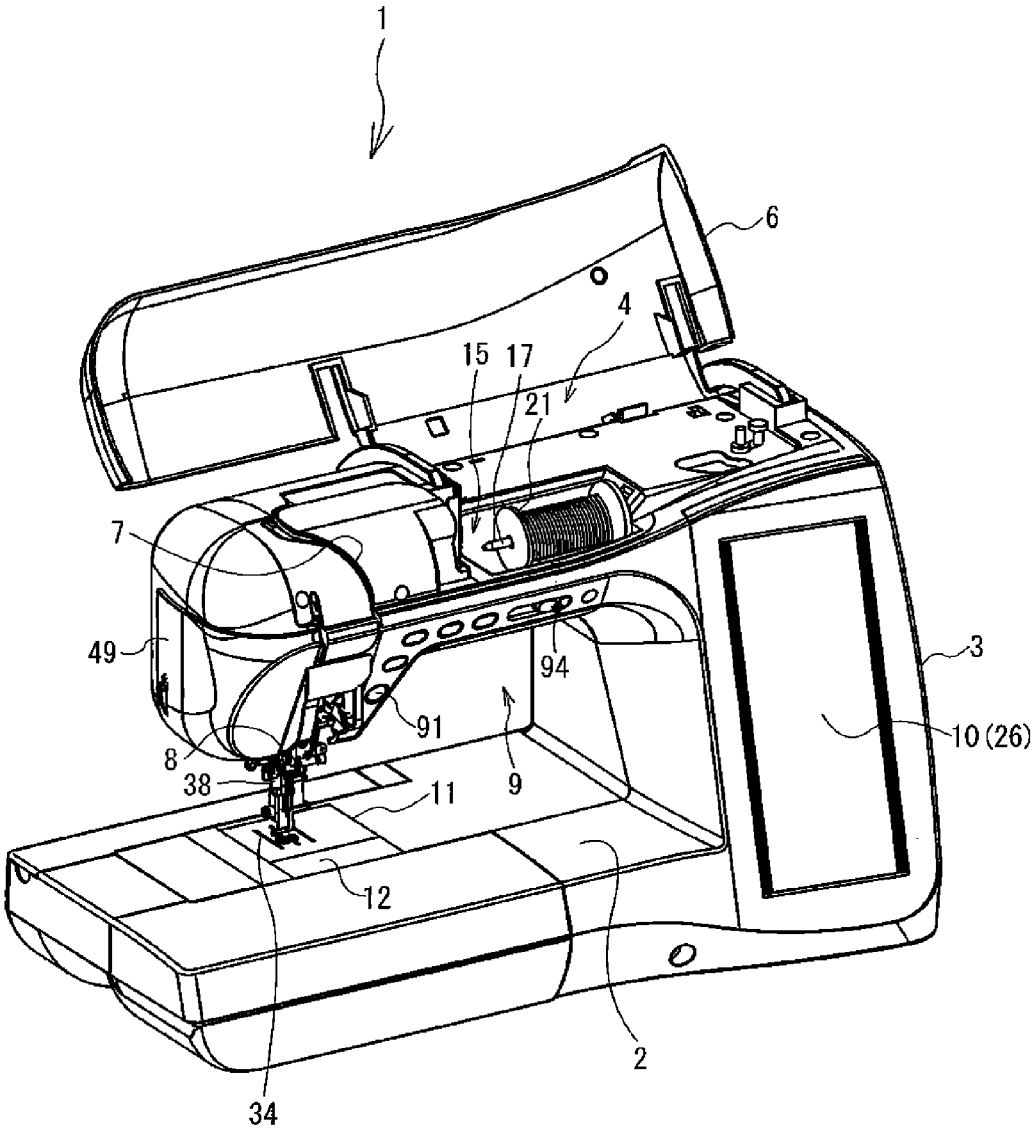
FIG. 1 is a perspective view of a sewing machine.
Figure 2:
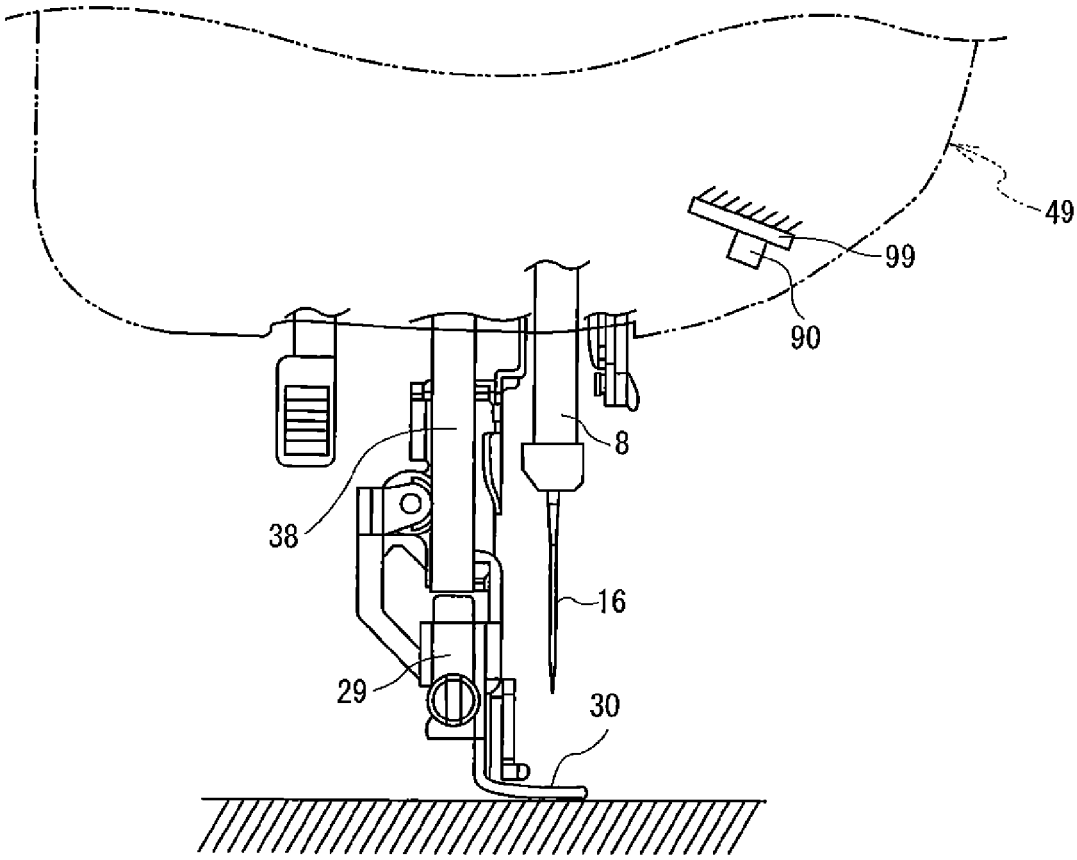
FIG. 2 is a diagram of an area around a sewing needle when the sewing machine is seen from the left side.

As shown in FIG. 1, the sewing machine 1 mainly includes a machine bed 2, a pillar 3 and an arm portion 4. The pillar 3 is provided in a vertical orientation on a right end portion of the machine bed 2. The arm portion 4 extends in the leftward direction from an upper end portion of the pillar 3, such that it is opposite the machine bed 2. A tip portion of the arm portion 4 is a head portion 49.

A needle plate 11 and a needle plate lid 12 that can be opened and closed are provided in the machine bed 2. A rectangular hole 34 is formed in the needle plate 11. A feed dog 57 that will be described later (refer to FIG. 3) can protrude from the rectangular hole 34. A shuttle mechanism (not shown in the figures), the feed dog 57 and a feed mechanism 58 (refer to FIG. 3) are provided inside the machine bed 2 located underneath the needle plate 11. The shuttle mechanism includes an inner shuttle (not shown in the figures) that houses a bobbin (not shown in the figures) on which a bobbin thread is wound. A tensioner member (not shown in the figures) that imparts a predetermined tension to the bobbin thread during sewing is provided inside the inner shuttle. The feed dog 57 can feeds a sewing object (for example, a work cloth) in the front-rear direction of the sewing machine 1 by a predetermined movement amount (a feed amount). The feed mechanism 58 is a known mechanism that can drives the feed dog 57. For example, Japanese Laid-Open Patent Publication No. 2006-346087 discloses the feed mechanism, the relevant portions of which are incorporated by reference. A feed adjustment motor 77 (refer to FIG. 3) can adjusts the movement amount of the feed dog 57, namely, the movement amount of the sewing object, to a predetermined value.

A sewing machine motor 79 (refer to FIG. 3) is provided on the lower side of the pillar 3. A driving force of the sewing machine motor 79 is transmitted to a drive shaft (not shown in the figures) via a driving belt (not shown in the figures). The drive shaft extends in the left-right direction inside the arm portion 4. A rotation angle of the drive shaft can be detected by a drive shaft angle sensor 32 (refer to FIG. 3). The drive shaft angle sensor 32 is basically the same as a known sensor and a simple explanation will be given here. For example, Japanese Laid-Open Patent Publication No. 2009-291416 discloses the drive shaft angle sensor, the relevant portions of which are incorporated by reference. A position in the up-down direction of a needle bar 8 is determined based on the rotation angle of the drive shaft that is detected by the drive shaft angle sensor 32. In a case where the drive shaft rotates by 360 degrees, a first stitch is formed (is sewn). Therefore, by continuously detecting the rotation angle of the drive shaft using the drive shaft angle sensor 32, the sewing machine 1 can detect that the first stitch has been formed. The driving force of the sewing machine motor 79 is also transmitted to a lower shaft (not shown in the figures) by a transmission mechanism (not shown in the figures) that is provided in a center portion of the drive shaft. The lower shaft extends in the left-right direction inside the machine bed 2. With this type of structure, materials may include the needle bar 8 that will be described later, a thread take-up lever mechanism (not shown in the figures), the shuttle mechanism (not shown in the figures) and the feed mechanism 58 can be driven in synchronization.

As shown in FIG. 1, a vertically-long liquid crystal display ("LCD") 10 is provided in the pillar 3. Function names and various types of messages etc. to perform various types of functions required for sewing operations can be displayed on the LCD 10, including such functions as selecting and editing a sewing pattern. A touch panel 26 is provided on a front surface of the LCD 10. In a case where a user selects an item displayed on the LCD 10 using a finger or a touch pen, the touch panel 26 can detect the item selected by the user. In this way, the user can input various commands via the LCD 10 and the touch panel 26.

An opening/closing cover 6 that extends along the whole length of the arm portion 4 in the left-right direction is provided on rear of an upper portion of the arm portion 4. The opening/closing cover 6 is pivotably supported at the rear upper edge of the arm portion 4 such that the opening/closing cover 6 can open and close by rotation around a shaft in the left-right direction of the arm portion 4. As shown in FIG. 1, in a case where the opening/closing cover 6 is opened, a housing portion 15 is provided in an upper portion of the arm portion 4. The housing portion 15 is concave portions that can house a thread spool 21 around which an upper thread is wound. A thread spool pin 17 that projects in the direction of the head portion 49 is provided on an inner wall surface of the housing portion 15 on the side toward the pillar 3. An insertion hole (not shown in the figures) with which the thread spool 21 is provided is inserted over the thread spool pin 17. The needle bar 8 is provided in a lower portion of the head portion 49. A sewing needle 16 can be mounted at a lower end of the needle bar 8. A presser bar 38 is provided on the rear side of the needle bar 8. A presser bracket (not shown in the figures) is affixed to a middle portion of the presser bar 38 in the height direction. A thickness detector 37 (refer to FIG. 3) is provided on the left side of the presser bracket. The thickness detector 37 is a known detector that can detect a thickness of the sewing object by detecting the height of the presser bracket. For example, Japanese Laid-Open Patent Publication No. 2009-291416 discloses the thickness detector, the relevant portions of which are incorporated by reference. A presser holder 29 can be attached to a lower end portion of the presser bar 38. A presser foot 30 can be attached to and removed from the presser holder 29. A needle bar up-and-down mechanism (not shown in the figures), a needle bar swing mechanism (not shown in the figures) and the thread take-up lever mechanism (not shown in the figures) are provided inside the head portion 49. The needle bar up-and-down mechanism can move the needle bar 8, to which the sewing needle 16 is mounted, in the upward and downward direction. The needle bar swing mechanism can move the needle bar 8 in the left-right direction. Although not shown in detail in the figures, a needle bar swing mechanism 59 swings a needle bar base (not shown in the figures) in the left-right direction by driving an eccentric swing cam (not shown in the figures). The swing cam can be moved circularly by a needle swing motor 78 (refer to FIG. 3) as a power source. The needle bar 8 can be swung in the left-right direction by the needle bar base (not shown in the figures) swinging in the left-right direction.

A thread tension adjustment mechanism 40 (refer to FIG. 3) is provided inside the arm portion 4. The thread tension adjustment mechanism 40 can adjust a tension of the upper thread and its power source may be a thread tension adjustment motor 76 (refer to FIG. 3). For example, Japanese Laid-Open Patent Publication No. 2008-212433 discloses the thread tension adjustment motor, the relevant portions of which are incorporated by reference. As shown in FIG. 1, a thread guide groove 7 is provided in the arm portion 4. The thread guide groove 7 can guide the upper thread that is pulled out from the thread spool 21 to the sewing needle 16 eventually, via the thread tension adjustment mechanism 40, a thread take-up spring and a thread take-up lever (both of which are not shown in the figures). A plurality of operation keys 9 may be provided on a front surface of the arm portion 4. The plurality of operation keys 9 can be used to make commands that cause various types of sewing operations to be performed. The operation keys 9 may include a sewing start-and-stop switch 91 and a speed controller 94, for example. The sewing start-and-stop switch 91 can be used to make a command to start or stop a sewing operation. In a case where the sewing start-and-stop switch 91 is depressed while the sewing operation is stopped, the sewing machine 1 starts the sewing operation. In a case where the sewing start-and-stop switch 91 is depressed while the sewing operation is under way, the sewing machine 1 stops the sewing operation. The speed controller 94 can be used to make a command to adjust a sewing speed (a rotation speed of the sewing machine motor 79).

An image sensor 90 may be attached to the head portion 49, to the front of and slightly to the right of the needle bar 8 in a front view. The image sensor 90 may be provided such that it can perform image capture of a whole of the needle plate 11. The image sensor 90 may include a CMOS sensor and a control circuit. The image sensor 90 can generate image data representing an image captured by the CMOS sensor. In the present embodiment, as shown in FIG. 2, a support frame 99 is attached to a sewing machine frame (not shown in this figures) of the sewing machine 1. The image sensor 90 may be affixed to the support frame 99. In a case where performing sewing processing that will be explained later, the image sensor 90 can generate image data representing an image captured of a surface (a top surface) of the sewing object, on which hand-sewn type stitches have been sewn.

Figure 3:
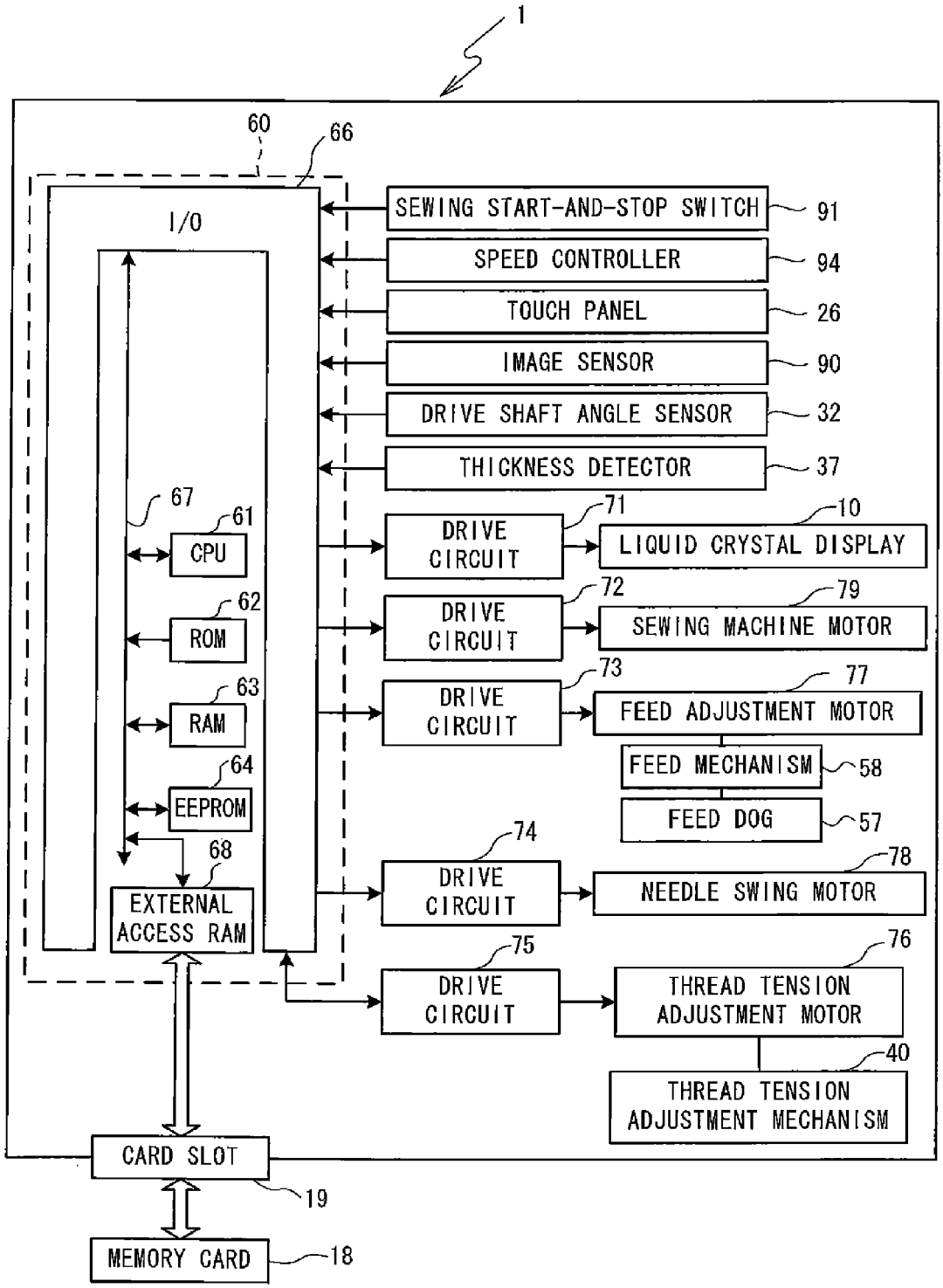
FIG. 3 is a block diagram showing an electrical configuration of the sewing machine.

An electrical configuration of the sewing machine 1 will be described with reference to FIG. 3. The sewing machine 1 may include a control portion 60. The control portion 60 may include a CPU 61, a ROM 62, a RAM 63, an EEPROM 64, an external access RAM 68 and an input/output interface 66, and those are connected to one another by a bus 67. The sewing start-and-stop switch 91, the speed controller 94, the touch panel 26, the image sensor 90, the drive shaft angle sensor 32, the thickness detector 37 and drive circuits 71 to 75 are all electrically connected to the input/output interface 66. The drive circuit 71 can drive the LCD 10. The drive circuit 72 can drive the sewing machine motor 79. The drive circuit 73 can drive the feed adjustment motor 77. The drive circuit 74 can drive the needle swing motor 78. The drive circuit 75 can drive the thread tension adjustment motor 76.

The CPU 61 conducts main control over the sewing machine 1. The CPU 61 performs various types of calculations and processes in accordance with programs stored in the ROM 62. The ROM 62 at least stores various types of programs and sewing data. The various types of programs include a program that is used to execute the sewing processing that will be described later. The RAM 63 is a storage element that can be read from and written to as desired. The RAM 63 may include various types of storage areas as required, the storage areas accommodating calculation results processed by the CPU 61. The EEPROM 64 at least stores various types of settings. A card slot 19 can be connected to the external access RAM 68. The card slot 19 can be connected to a memory card 18. By connecting the card slot 19 and the memory card 18, the sewing machine 1 can read information from and write information into the memory card 18.

Figure 5:
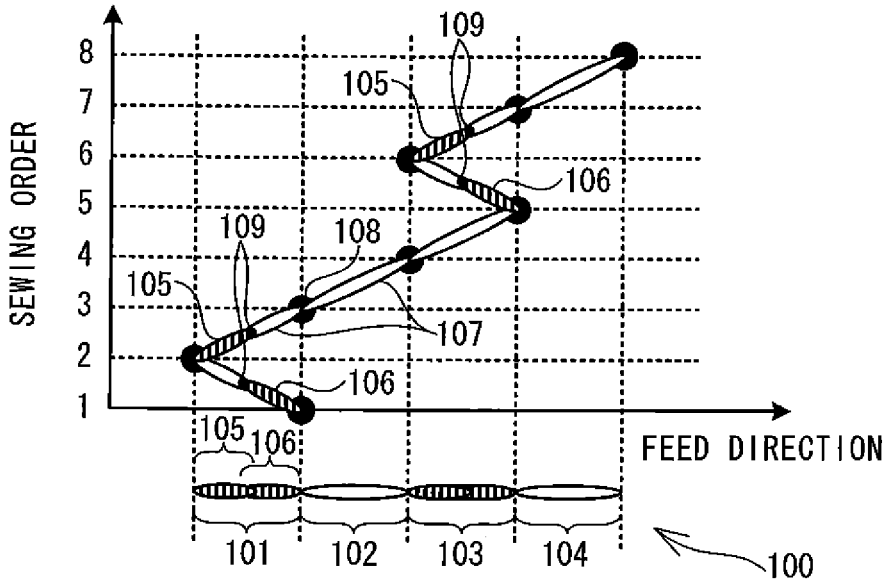
FIG. 5 is an explanatory diagram of the hand-sewn style stitches.

Next, the hand-sewn style stitches will be explained. FIG. 5 shows an example of hand-sewn style stitches 100. The hand-sewn style stitches 100 of the present embodiment are stitches that are sewn by a transparent thread as the upper thread and a colored thread as the bobbin thread. In the hand-sewn style stitches, a first stitch and a second stitch are arranged alternately on a top surface of the sewing object at the time of sewing. The top surface of the sewing object at the time of sewing is herein means the top surface of the sewing object placed on the machine bed 2 in order to form the hand-sewn style stitches. Hereinafter, the top surface of the sewing object at the time of sewing will also simply be referred to as the top surface of the sewing object. The first stitch is a stitch for which an interlacing point of the upper thread and the bobbin thread is lower than the top surface of the sewing object. In other words, in the first stitch, only the transparent upper thread appears on the top surface of the sewing object. The second stitch includes a stitch in which, due to the tension of the upper thread, the interlacing point of the upper thread and the bobbin thread and the bobbin thread are pulled up to the top surface of the sewing object. More specifically, the second stitch includes at least one set of a first section and a second section. The first section is a section in which the bobbin thread is pulled out in a first direction. The second section is a section in which the bobbin thread is pulled out in a second direction and at least a part of the second section overlaps with the first section. The first direction and the second direction are feed directions of the sewing object fed by the sewing machine 1. The first direction is a direction from the front toward the rear of the sewing machine 1. The second direction is a direction from the rear to the front of the sewing machine 1, namely the direction opposite to the first direction. In the present embodiment, the first direction is defined as a plus feed direction and the second direction is defined as a minus feed direction.

Sewing data 201 shown in FIG. 4 include the second stitch which includes a single set of the first section and the second section. The sewing data 201 include data numbers, a feed amount and a flag. The feed amount is, for example, a unit in millimeters represented by a numeral. In the present embodiment, in a case where the feed amount is a positive value, the sewing object can be fed by the feed dog 57 in the first direction. In a case where the feed amount is a minus value, the sewing object can be fed by the feed dog 57 in the second direction. The flag can be used in processing that adjusts the upper thread tension to one of either a first predetermined value or a second predetermined value. In the present embodiment, in a case where the stitch is sewn to form the first section and the second section included in the second stitch (in a case where the flag is 1), the sewing machine 1 sets the second predetermined value as the upper thread tension. In a case where another of the stitches is sewn (in a case where the flag is 0), the sewing machine 1 sets the first predetermined value as the upper thread tension. The other stitches of the present embodiment include the first stitch and stitches that are not the first section and the second section of the second stitch. As will be explained later with reference to FIG. 12, the second predetermined value is larger than the first predetermined value. In a case where the hand-sewn style stitches 100 are formed in accordance with the sewing data 201, in a first cycle of processing (in a case where first to fifth needle drop points of a sewing order shown in FIG. 5 are formed), stitches are formed in accordance with data corresponding to data numbers 0 to 4. From a second cycle of processing onwards (when needle drop points from the sixth needle drop point onwards in the sewing order shown in FIG. 5 are formed), the data with the data number 0 are omitted and the stitches are formed in accordance with the data corresponding to the data numbers 1 to 4.

A graph shown in the upper part of the page in FIG. 5 schematically shows relationships between the needle drop points 108 and a sewing order of the needle drop points 108 that are sewed in accordance with the sewing data 201, relative positions of the feed direction and stitches that are formed on the top surface of the sewing object based on the sewing data 201. The stitches formed on the top surface of the sewing object may include a third section 107, interlacing point 109, a first section 105 and a second section 106. The third section 107 is a section in which the upper thread appears on the top surface of the sewing object. As can be understood from FIG. 4 and FIG. 5, in the stitches that are formed based on the data for which the flag is set to 1, the interlacing points 109 of the upper thread and the bobbin thread, the first section 105 and the second section 106 appear on the top surface of the sewing object. The first section 105 is the bobbin thread that has been pulled in the first direction by the upper thread. The second section 106 is the bobbin thread that has been pulled in the second direction by the upper thread. On the other hand, in the stitches that are formed based on the data for which the flag is set to 0, the interlacing point is lower than the top surface of the sewing object and does not appear on the top surface of the sewing object.

Of stitches 101 to 104 that are included in the hand-sewn style stitches 100 that are shown in the lower part of the page in FIG. 5, the stitches 101 and 103 are the second stitches. The stitches 102 and 104 are the first stitches. The first stitch and the second stitch are arranged alternately in terms of the feed direction. Each of the first stitches includes a single stitch. Each of the second stitches includes two stitches. In the present embodiment, the number of stitches included in each of the second stitches varies depending on the number of sets of the first section and the second section included in each of the second stitches. In a case where the tension of the upper thread is not appropriately adjusted, there may be cases in which a defective stitch is formed. The defective stitch may occur in a case where a gap arises between the first section and the second section. The defective stitch herein means a second stitch in which a length of a section in which the bobbin thread appears on the top surface is equal to or less than a length of the second stitch that should be sewn. In the present embodiment, in order to inhibit the occurrence of defective stitches, the number of sets of the first section and the second section to be included in the second stitch is set while taking into account sewing conditions.

The sewing processing performed by the sewing machine 1 will be explained with reference to FIG. 6 to FIG. 13. Sewing conditions are input as appropriate, and the sewing processing can be performed in a case where a command is input to start sewing of the hand-sewn style stitches. The command to start sewing of the hand-sewn style stitches can be performed, for example, in a case where the sewing start-and-stop switch 91 is selected. The program to perform the sewing processing shown in FIG. 6 may be stored in the ROM 62, and can be executed by the CPU 61. In the following explanation, an image that is represented by image data generated by the image sensor 90 is referred to as a captured image.

In the sewing processing, first, setting processing is performed (step S10). In the setting processing, a number of sets of the first section and the second section included in each of the second stitches is set. The setting processing will be explained in detail with reference to FIG. 7. First, it is determined whether the number of sets has been specified (step S22). In a case where the number of sets has been specified as a sewing condition before the start of the sewing processing (yes at step S22), the number of sets is set in accordance with the specified condition. The set number of sets is stored in the RAM 63 (step S24). In the present embodiment, a natural number equal to or greater than 1 can be set as the number of sets. In a case where the number of sets has not been set (no at step S22), it is determined whether a width of the second stitch has been specified (step S26). In the present embodiment, the width is a maximum length of the second stitch in a direction that is orthogonal to the feed direction. Specifically, the width of the second stitch means a maximum length of the bobbin thread included in the second stitch in a direction that is orthogonal to the feed directions of the sewing object. In a case where the width of the second stitch has been specified as a sewing condition before the start of the sewing processing (yes at step S26), the number of sets is set based on the specified width of the second stitch and on a table 202 shown in FIG. 8. The set number of sets is stored in the RAM 63 (step S28). A relationship between the width (mm) of the second stitch and the number of sets may be set in advance as shown in the table 202, in accordance with the width of the upper thread and may be stored in advance in the EEPROM 64. In the processing at step S28, the table 202 is referred to and the number of sets is set in accordance with the specified width of the second stitch.

In a case where the width of the second stitch has not been specified (no at step S26), it is determined whether a feed pitch (a feed amount per each needle drop) has been specified (step S30). In a case where the feed pitch has been specified (yes at step S30), the number of sets is set based on the specified feed pitch and a table 203 shown in FIG. 9. The set number of sets is stored in the RAM 63 (step S32). A relationship between the feed pitch (mm) and the number of sets may be set in advance as shown in the table 203 and may be stored in advance in the EEPROM 64. In the present embodiment, the feed pitch can be specified over a range of 1.0 mm to 4.0 mm. In the processing at step S32, the number of sets is set in accordance with the specified feed pitch. In a case where the feed pitch has not been specified (no at step S30), a default value is set as the number of sets and the set number of sets is stored in the RAM 63 (step S34). In the present embodiment, the default value of the number of sets is 2. After any one of step S24, step S28, step S32 and step S34, the setting processing ends and the processing returns to the sewing processing shown in FIG. 6.

Figure 11:
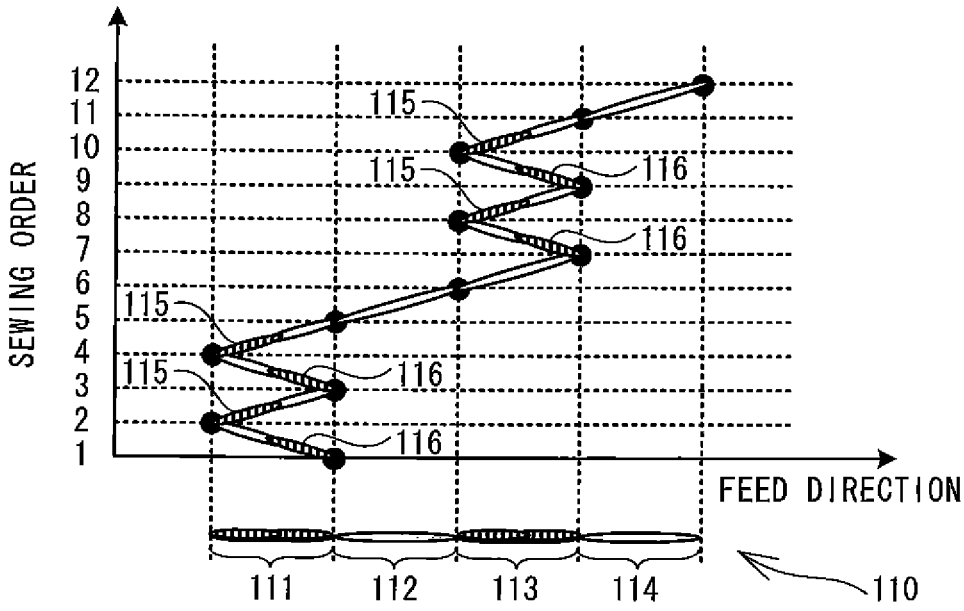
FIG. 11 is an explanatory diagram of the hand-sewn style stitches.

After the processing at step S10, sewing data are generated based on the set feed pitch and the set number of sets. The generated sewing data are stored in the RAM 63 (step S40). The feed pitch may be the specified value or a default value. In the present embodiment, the default value of the feed pitch is 2.0 mm. In a case where the feed pitch is 2.0 mm and the number of sets is 2, in the processing at step S40, sewing data 204 shown in FIG. 10 are generated. Similarly to the sewing data 201 shown in FIG. 4, the sewing data 204 include data numbers, a feed amount and a flag. In a case where sewing is performed in accordance with the sewing data 204, hand-sewn style stitches 110 shown in FIG. 11 are formed on the top surface of the sewing object. The hand-sewn style stitches 110 include stitches 111 to 114. The stitches 111 and 113 are the second stitches. The stitches 112 and 114 are the first stitches. The stitches 111 and 113 include two sets of first sections 115 and second sections 116. In the processing at step S40, a counter variable m is set to 0. The set counter variable m is stored in the RAM 63. The counter variable m is a variable that is used in order to read out data, in accordance with the data number, that are included in the generated sewing data.

Next, m-th data that are included in the generated sewing data are read out (step S50). Then, based on an output of the thickness detector 37, a thickness of the sewing object can be detected. The detected thickness is stored in the RAM 63 (step S60). Next, a control signal is output to the drive circuit 75 and the tension of the upper thread is adjusted (step S70). The tension of the upper thread can be set based on the flag of the data read out in the processing at step S50, the thickness detected in the processing at step S60 and a table 205 shown in FIG. 12. In the present embodiment, a predetermined tension (0.1 N, for example) is imparted to the bobbin thread by a tensioner member of the inner shuttle. The table 205 may be stored in advance in the EEPROM 64. As shown in the table 205, in a case where the flag of the m-th data is set to 1, a different tension of the upper thread is set in accordance with the thickness of the sewing object. In the present embodiment, in a case where the detected thickness is 1.5 mm and the flag is set to 1, the tension of the upper thread is set to 2.8 N. In a case where the flag of the m-th data is set to 0, the tension of the upper thread is constant, irrespective of the thickness of the sewing object. In the present embodiment, in a case where the flag is set to 0, the tension of the upper thread is set to 0.35

Figure 13:
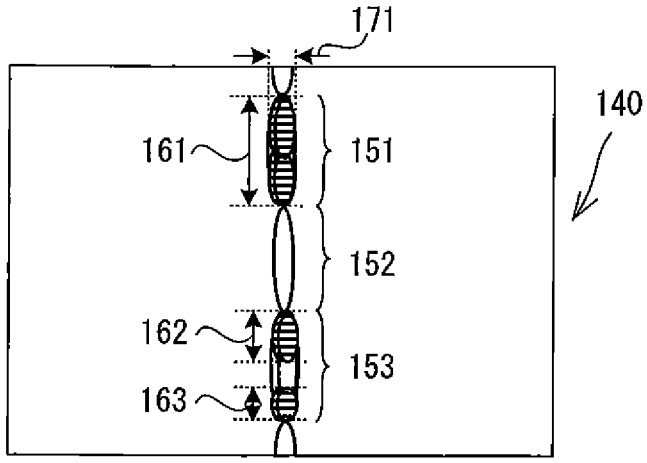
FIG. 13 is an explanatory diagram of a captured image of a specific example.

N. The tension of the upper thread can be adjusted by the thread tension adjustment mechanism 40 (refer to FIG. 3). The thread tension adjustment mechanism 40 can be operated by the thread adjustment motor 76 (refer to FIG. 3) that may be driven in accordance with the control signal output by the drive circuit 75 (refer to FIG. 3) and thus operating Next, in accordance with the feed amount read out in the processing at step S50, a control signal is output to the drive circuit 73 (refer to FIG. 3) and the feed adjustment motor 77 (refer to FIG. 3) is driven (step S80). Then, a control signal is output to the drive circuit 72 (refer to FIG. 3) and rotation of the drive shaft (not shown in the figures) is started or continued (step S90). Next, it is determined whether it is an image capture timing (step S100). In the present embodiment, it is determined that it is the image capture timing in a case where the data read out in the processing at step S50 is the data with the largest data number, of the sewing data generated in the processing performed at step S40. In a case where the number of sets set in the processing at step S10 is 2, the largest data number is 6, as shown in FIG. 10. In a case where it is not the image capture timing (no at step S100), processing at step S170, which will be described later, is performed. In a case where it is the image capture timing (yes at step S100), the CPU 61 waits on stand-by until the movement of the sewing object stops (step S110). Processing at step S110 is performed while the sewing object is stopped, in order to acquire image data representing an image with little distortion. The processing at step S110 determines, for example, whether the sewing object is moving, based on a signal output from the drive shaft angle sensor 32. Next, image data output from the image sensor 90 can be acquired. The acquired image data are stored in the RAM 63 (step S120). In the processing at step S120, a specific example is assumed in which image data representing a captured image 140 shown in FIG. 13 are acquired. For ease of explanation, the captured image 140 is assumed not to include the presser foot 30 and other members. Stitches 151 to 153 are included in the captured image 140.

Next, based on the acquired image data, it is determined whether, with respect to each of the second stitches, there is a part in which the first section and the second section overlap (step S130). For example, it is determined whether a part in which the first section and the second section overlap with respect to each of the second stitches, by the following type of processing. Based on the acquired image data, an area of the bobbin thread in the captured image is extracted and a length (number of pixels) that the area of the bobbin thread is continuous in the feed direction is calculated. A specific example will be explained with reference to FIG. 13, taking as an example a case in which the bobbin thread used is a red colored thread. First, values of a range of 0 to 255 for each of RGB values are attributed, respectively, to each of pixels represented by the acquired image data. Next, a bobbin thread (red color) pixel number counter i is set to 0. Then, for each pixel, it is determined whether a target pixel is red. For example, in a case where the R value is 100 or more and the both B and G values are 99 or less, it is determined that the target pixel is red.

In a case where it is determined that the pixel is red, the bobbin thread (red color) pixel number counter i is increased by 1. It is determined whether all the pixels are colored red. A maximum length in which the pixels that are determined to be red are continuous in the feed direction is calculated. In the specific example, the feed direction is a direction that is orthogonal to a longitudinal direction of the image represented by the image data. In the specific example, as maximum lengths in which the red color is continuous in the feed direction, lengths are calculated as indicated by arrows 161, 162 and 163. Then, it is determined whether the lengths indicated by the arrows 161, 162 and 163 are within a range of 95% to 105% of the set feed pitch. In a case where all of the lengths are within the range of 95% to 105% of the set feed pitch, it is determined that there is overlap in the second stitches (yes at step S130). In this case, processing at step S150, which will be explained later, is performed.

In a case where at least one of the calculated lengths is not within the range of 95% to 105% of the set feed pitch, it is determined that there is no overlap in the second stitches (no at step S130). For example, in a case where the first section and the second section of the second stitch do not overlap, as with the stitch 153, it is determined that there is no overlap in the second stitches. In a case where it is determined that there is no overlap in the second stitches, the tension of the upper thread when the flag is 1 in the table 205 shown in FIG. 12 is corrected. The corrected table 205 is stored in the RAM 63 (step S140). In processing at step S140, for example, the tension of the upper thread when the flag stored in the table 205 is 1 is uniformly increased by 0.05 N.

Next, based on the image data acquired in the processing at step S120, it is determined whether the calculated width of the second stitch is within a predetermined range, such as a range of 70% to 130% of the set width, for example (step S150). In the present embodiment, in a case where the width of the second stitch is not set before the start of the sewing processing, a value depending on the width of the upper thread and the number of sets may be set as the width of the second stitch. The width of the second stitch is, as shown in FIG. 13, for example, a width indicated by an arrow 171. The width of the second stitch is calculated by processing similar to the processing at step S130 to calculate the length of the second stitch. In the above-described specific example, the width of the second stitch is a maximum length in which the pixels that are determined to be red are continuous, in a direction that is orthogonal to the feed direction.

In a case where it is determined that the calculated width of the second stitch is not within the range of 70% to 130% of the set value (no at step S150), the number of sets is corrected. The sewing data is corrected based on the corrected number of sets (step S160). The corrected number of sets and sewing data are stored in the RAM 63. In a case where the width of the second stitch is more than 130% of the set value, the number of sets is reduced by 1, for example. In a case where the width of the second stitch is less than 70% of the set value, the number of sets is increased by 1, for example. The correction of the sewing data is performed in accordance with the correction of the number of sets. In a case where it is determined that the width of the second stitch is within the range of 70% to 130% of the set value (yes at step S150), or after the processing at step S160, it is determined whether a command has been input to end the sewing (step S170). The command to end the sewing is input, for example, by operating the sewing start-and-stop switch 91. In a case where the command to end the sewing has not been input (no at step S170), the counter variable m is updated and the updated counter variable m is stored in the RAM 63 (step S180). In processing at step S180, in a case where the counter variable m is smaller than the maximum value of the data numbers (in a case where it is less than 6, in the present embodiment), the counter variable m is incremented. In a case where the counter variable m is equal to the maximum value of the data numbers (in a case where it is 6, in the present embodiment), the counter variable m is set to 1. Next, the processing returns to step S50. In a case where the command to end the sewing has been input (yes at step S170), the sewing processing ends.

By adjusting the tension of the upper thread, the sewing machine 1 can favorably form hand-sewn style stitches on the sewing object. The thread tension adjustment mechanism 40 can adjust the tension of the upper thread. Taking the sewing conditions into account, the sewing machine 1 sets the number of sets of the first section and the second section to be included in the second stitch. More specifically, the sewing machine 1 may make the number of sets of the first section and the second section included in the second stitch a plurality in any one of following cases, for example. In a case that a plurality of the sets is specified, a value of 0.3 or more is specified as the width of the second stitch as shown in FIG. 8, 1.5 mm or more is specified as the feed pitch or the default value is set as the number of sets at step S34. Although not shown in the figures, compared to a case in which the number of sets of the first section and the second section is a single set, the sewing machine 1 can more reliably inhibit the occurrence of defective stitches in a case where there is a plurality of the sets of the first section and the second section included in each of the second stitches. As shown in FIG. 8, by adjusting the number of sets of the first section and the second section, the sewing machine 1 can adjust the width of the second stitch.

Under a condition that the tension of the upper thread is constant, in a case where the sewing objects that have different thicknesses are sewn, the lengths of the first section and the second section that are included in the second stitch are generally different depending on the thickness of the sewing object. Therefore, the sewing machine 1 can adjust the tension of the upper thread in a case where the flag is 1, depending on the thickness of the sewing object. As a result, the sewing machine 1 can favorably form the hand-sewn style stitches on the sewing object, irrespective of the thickness of the sewing object. With respect to each of the second stitches, when overlap between the first section and the second section is not detected (no at step S130), the sewing machine 1 sets the tension of the upper thread such that the first section and the second section overlap at least in part (step S140). The sewing machine 1 can thus inhibit the forming of defective stitches and can favorably form the hand-sewn style stitches on the sewing object.

The sewing machine 1 is not limited to the above-described embodiment, and various modifications may be applied without departing from the spirit and scope of the present disclosure. For example, any one of the following modifications (A) to (C) may be applied as appropriate.

(A) The configuration of the sewing machine 1 may be appropriately modified as necessary. For example, an industrial sewing machine or a multi-needle sewing machine may be adopted as the sewing machine 1. The type and arrangement of the image sensor 90 may be modified as appropriate. For example, the image sensor 90 may be an imaging element other than the CMOS image sensor, such as a CCD camera or the like. In a case where the processing at step S60 is omitted, the sewing machine 1 needs not necessarily to include the thickness detector 37. In a case where the processing from step S100 to step S160 is omitted, the sewing machine 1 need not necessarily to include the image sensor 90.

(B) The color of the threads used to sew the hand-sewn style stitches may be any color as long as the color of the upper thread color is different to the color of the bobbin thread. For example, the color of the upper thread may be set as a color that is the same as or similar to the color of the sewing object.

Figure 6:
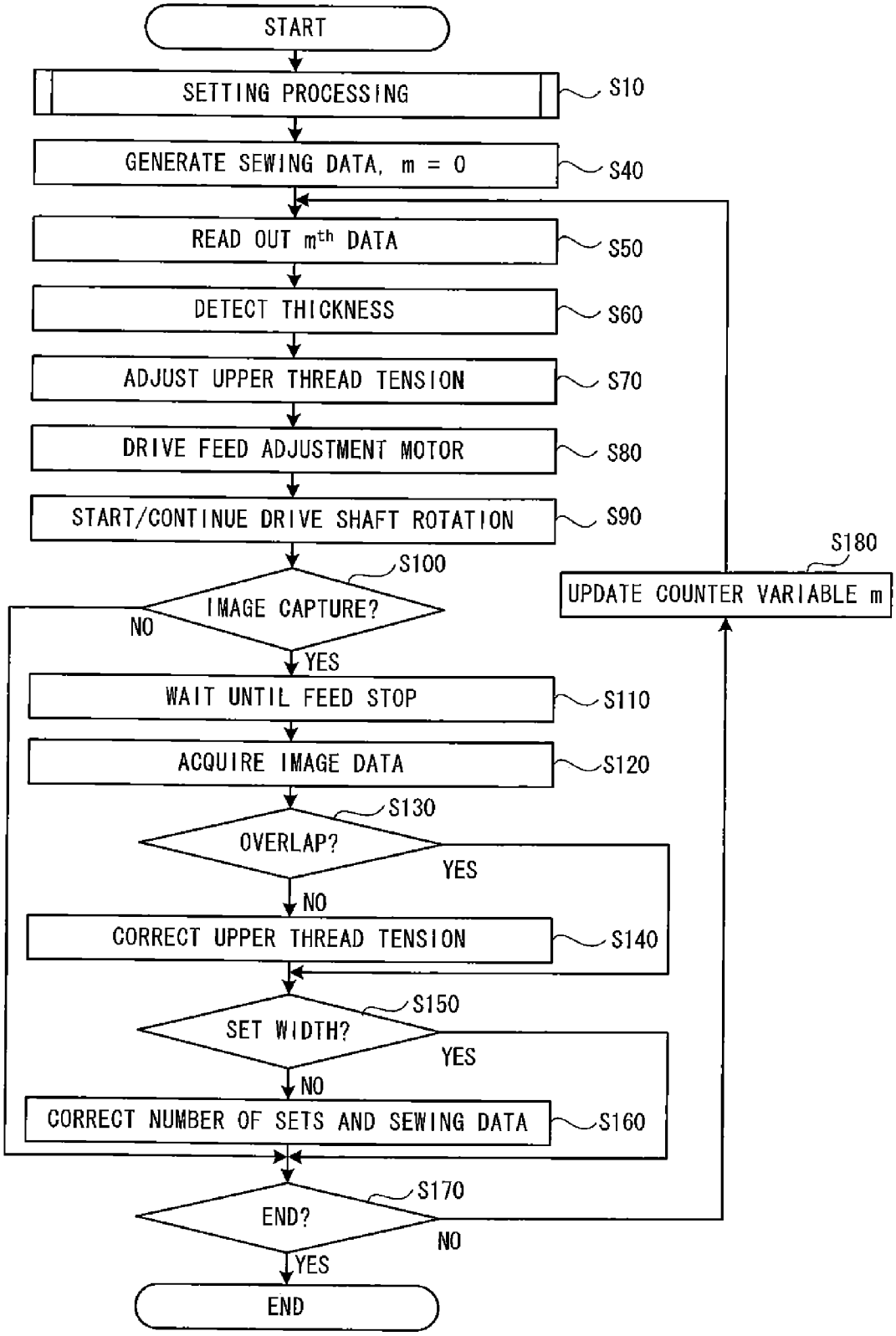
FIG. 6 is a flowchart of sewing processing.
Figure 7:
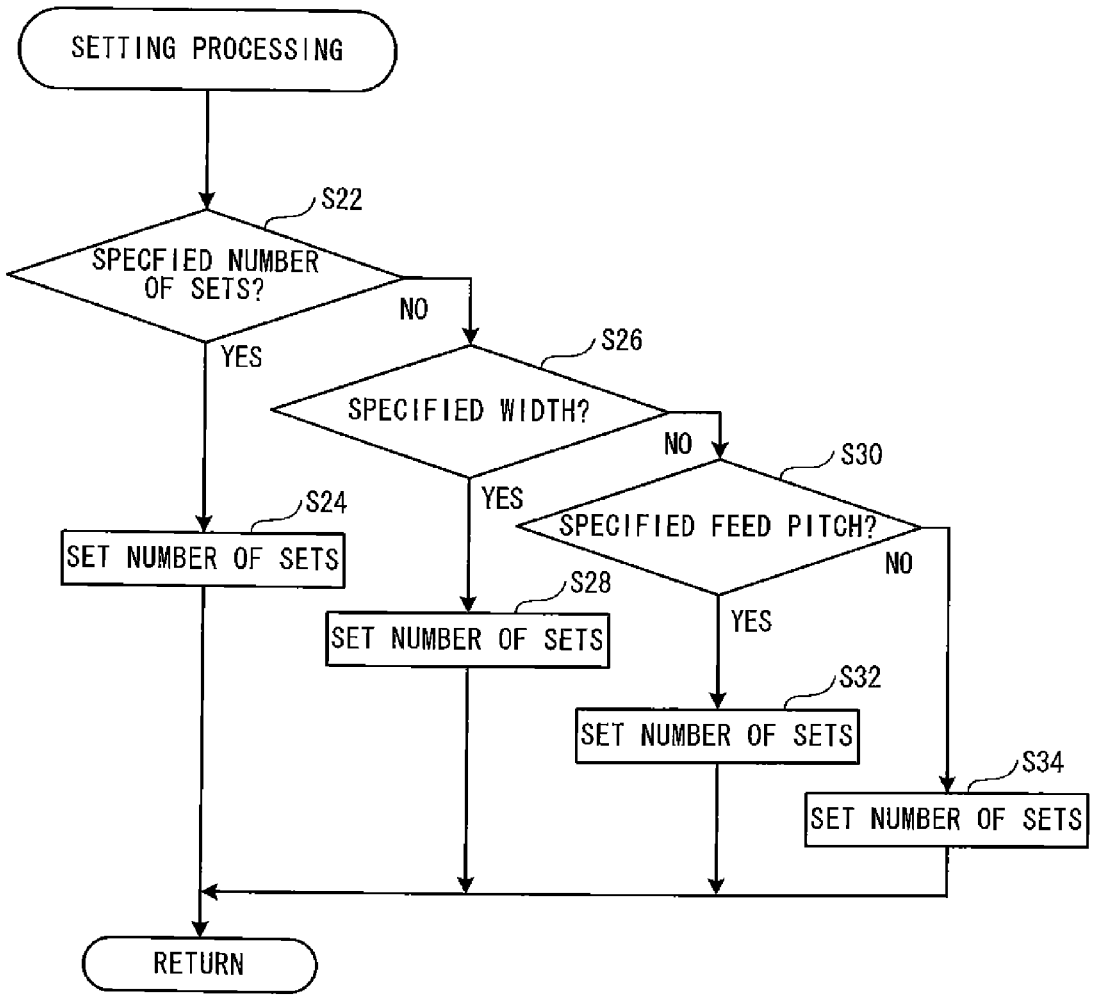
FIG. 7 is a flowchart of setting processing that is performed in the sewing processing shown in FIG. 6.

(C) The sewing processing shown in FIG. 6 may be modified as appropriate. For example, any one of the following modifications (C-1) to (C-6) may be added.

(C-1) The setting processing at step S10 maybe modified as appropriate. More specifically, some of the processing steps from step S22 to step S34 shown in FIG. 7 may be omitted.

(C-2) The data included in the sewing data generated in the processing at step S40 may be modified as necessary. For example, instead of the flag, the tension of the upper thread may be included in the sewing data. 0 is set as the flag for the stitch with the last data number included in the sewing data, but the flag may be set to 1.

(C-3) The tension of the upper thread in a case where the flag is 1 may be a constant value, irrespective of the thickness of the sewing object. In this case, the tension of the upper thread may be a default value or may be a specified value. The tension of the upper thread in a case where the flag is 0 may differ depending on the thickness of the sewing object.

(C-4) A determination criterion of the processing at step S100 may be modified as appropriate. For example, it may be determined that it is the image capture timing in a case where it is determined that a stitch of a predetermined length has been formed. Also, in the above-described embodiment, for ease of explanation, the members such as the presser foot 30 and so on are not included in the captured image. However, the members such as the presser foot 30 and so on may be included in the captured image.

(C-5) All or a part of the processing from step S100 to step S160 may be modified or omitted as necessary. For example, the value set in the processing at step S140 may be a specified value. In the processing at step S140, in place of the processing that corrects the tension of the upper thread, processing may be performed that increases the number of sets of the first section and the second section included in the second stitch. Each of the processing at step S130 and step S140 may be omitted. In a case where the width of the second stitch is not set or the like, the processing at step S150 and step S160 may be omitted.

(C-6) The tables and the set values that can be referred to in the sewing processing may be modified as appropriate.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine comprising:

a thread tension adjustment portion that adjusts a thread tension, the thread tension being a tension of an upper thread that is configured to be supplied to a sewing needle;

a feed portion that is configured to feed a sewing object in a first direction and in a second direction, the second direction being a direction opposite to the first direction; and a control portion that is configured to control the thread tension adjustment portion and the feed portion such that a first stitch and a second stitch are configured to be formed alternately on the sewing object, the first stitch including only a stitch in which an interlacing point of the upper thread and a bobbin thread that is a different color to the upper thread is lower than a top surface of the sewing object, the second stitch including at least one set of a first section and a second section, the first section being a section in which the interlacing point and the bobbin thread can be pulled out, by the thread tension, in the first direction on the top surface of the sewing object, the second section being a section in which the bobbin thread can be pulled out in the second direction, and at least part of the second section overlapping with the first section;

wherein the control portion sets a first tension value that is a predetermined value as the thread tension in a case where the first stitch is sewn and sets a second tension value as the thread tension in a case where the second stitch is sewn, and controls the thread tension adjustment portion in accordance with the set thread tension, the second tension value being larger than the first tension value.

2. The sewing machine according to claim 1, further comprising:

a thickness detection portion that is configured to detect a thickness of the sewing object;

wherein the control portion controls the thread tension adjustment portion in accordance with the thickness of the sewing object detected by the thickness detection portion thereby adjusting the thread tension.

3. The sewing machine according to claim 1, further comprising:

an image capture portion that is configured to capture an image of stitches formed on the sewing object and generate image data; and an overlap detection portion that, based on the image data generated by the image capture portion, detects an overlap between the first section and the second section;

wherein in a case where the overlap detection portion does not detect the overlap, the control portion sets as the thread tension a value that is larger than the second tension value and controls the thread tension adjustment portion in accordance with the set thread tension.

4. The sewing machine according to claim 1, further comprising:

an image capture portion that is configured to capture an image of stitches formed on the sewing object and generate image data;

a width detection portion that, based on the image data generated by the image capture portion, detects a width of the second stitch as a detected value, the width being a maximum length of the second stitch in a direction that is orthogonal to the first direction; and a number of sets updating portion that, based on the detected value detected by the width detection portion and on a set value, updates a number of sets of the first section and the second section, the set value being a value that is set in relation to the width.

5. The sewing machine according to claim 1, wherein the second stitch includes a plurality of the sets of the first section and the second section.

* * * * *